United States Patent [19]

Kelly et al.

[11] Patent Number: 4,890,565

[45] Date of Patent: Jan. 2, 1990

[54] APPARATUS FOR SECURING ON-DECK CONTAINERS

[75] Inventors: Eugene M. Kelly, Runson, N.J.; Robert B. Barnett, Mobile, Ala.

[73] Assignee: Sea-Land Service, Inc., Iselin, N.J.

[21] Appl. No.: 755,956

[22] Filed: Jul. 16, 1985

Related U.S. Application Data

[63] Continuation of Ser. No. 688,285, Jan. 7, 1985, abandoned, which is a continuation of Ser. No. 475,377, Mar. 14, 1983, abandoned.

[51] Int. Cl.[4] ..... B63B 25/00

[52] U.S. Cl. ..... 114/72

[58] Field of Search ..... 114/72; 410/77, 78, 410/79, 90, 91

[56] References Cited

U.S. PATENT DOCUMENTS

| | | | |
|---|---|---|---|
| 3,680,518 | 8/1972 | Tabuchi et al. | 114/72 |
| 3,776,169 | 12/1973 | Strecker | 114/72 |
| 3,818,852 | 6/1974 | Lewis et al. | 114/72 |

FOREIGN PATENT DOCUMENTS

| | | |
|---|---|---|
| 2023496 | 12/1970 | Fed. Rep. of Germany . |
| 2024333 | 11/1974 | Fed. Rep. of Germany . |

OTHER PUBLICATIONS

*The Motor Ship*, "Deck Cell Guide Experiments on ACL Roro Container Ship", vol. 63, Dec. 1982, No. 749, pp. 40–41.

*Primary Examiner*—Sherman D. Basinger
*Assistant Examiner*—Edwin L. Swinehart
*Attorney, Agent, or Firm*—Scully, Scott, Murphy & Presser

[57] ABSTRACT

Apparatus is provided for securing containers on the deck of a containership. Tower assemblies are provided on either side of a container body. A lowermost tier of containers is engaged by castings and dowels mounted on deck or hatch covers. Cantilevered platforms mounted between vertical tower members pivot outwards to lie atop the containers. Dowels carried on the cantilevered platforms are positioned to engage the bottom locating apertures of the second tier of containers. Similar apparatus is provided for subsequent tiers. The uppermost tier rests upon a cantilevered platform, and also is retained in vertical position by a locking dowel engaging the horizontal locating aperture of the container.

6 Claims, 4 Drawing Sheets

APPARATUS FOR SECURING ON-DECK CONTAINERS

This application is a continuation, of application Ser. No. 688,285, filed Jan. 7, 1985 which is a continuation of application Ser. No. 475,373 filed Mar. 14, 1983, both now abandoned.

BACKGROUND OF THE INVENTION

This invention relates to cargo-handling apparatus for use on containerships. More particularly, the invention relates to apparatus for securing stacks of containers carried on the deck of a containership.

The advent of the container has pointed the way to potentially great savings in time and labor in handling cargos. Realizing that potential, however, has required the development of specialized apparatus for transporting and handling containers. The most dramatic development has been the evolution of the containership, with attendant port facilities designed specifically for rapid handling of containerized cargo. Such ships not only carry containers in their holds, but also containers may be stacked on deck, permitting maximum utilization of available space.

On-deck containers present several problems. First, the stacks of containers must be fixed securely in position, to prevent their movement—and resulting damage—during the pitching and rolling to be expected during an ocean voyage. Second, the means employed to secure the containers must be easy to use, to permit rapid loading and unloading; otherwise, the potential for savings of time and effort will be lost. Third, a securing apparatus should not unduly raise the ship's center of gravity. Ideally, the securing apparatus should be lightweight and low to the deck, allowing containers to be stacked to the maximum height consistent with ship stability; short of the ideal, every effort should be made to keep the apparatus as low as possible. Fourth, the apparatus must be reliable and maintenance-free. In an environment where containers, hatch covers, and other equipment typically are handled by cranes, the apparatus cannot be prone to damage or downtime.

The original method for securing containers is by lashing. The bottom container of a stack is placed on deck—or, more specifically on a hatch cover, as hatch covers form the most convenient deck area for storage—with its corners engaged by castings, which restrain side-to-side movement. Vertical locating apertures are fitted in the corners of the container top and bottom, and horizontal locating apertures similarly are located in the corners of the ends and sides. Dowels placed in the vertical locating apertures atop one container engage similar apertures in the bottom of a subsequent container, to prevent side-to-side movement. The entire stack is then held in place by lashings fitted with turnbuckles and the like. Obviously, rigging such lashings is highly labor intensive and consumes valuable dockside time. Also, lashings require frequent inspection and maintenance during a voyage and must be replaced frequently.

Some of the disadvantages of lashings are overcome by providing stacking frames in lieu of lashings. Most such apparatus is bulky and must be moved into place by cranes, however, considerably lengthening the time required to on-load and off-load a ship. In addition, the frames commonly in use result in a higher stack of containers, often raising the ship's center of gravity unacceptably. For example, one typical stacking frame system results in a container stack 1.2 feet higher than the stack would be if lashed in place. Even such a seemingly small difference in center of gravity can result in the ship becoming marginally unstable; in such a situation, there is no choice but to leave cargo behind.

Another system employs fixed cell guides on deck. Such guides must be located so that containers fit snugly against guide rails. Because containers usually are stacked on hatch covers, however, the cell guides must overlap onto them, resulting in considerable difficulty in removing the hatch covers. One is faced with a choice of employing fixed cell guides and accepting a high level of damage during hatch cover removal, or employing removable cell guides, which require additional time during loading and unloading to erect and dismantle the guide systems.

A disclosure by Tabuchi, U.S. Pat. No. 3,680,518, attempts to solve these problems by providing apparatus comprising pillars located adjacent the hatch covers, carrying swinging arms with pins which engage the container locating apertures. A pivot arm is provided for each container in a stack, including the top one. This system possesses two major disadvantages. First, it does not overcome the problem encountered by cell guides in that the swinging arms, even in their retracted position, are vulnerable to damage during removal of a hatch cover. One can imagine the difficulty of lifting a heavy hatch cover past successive rows of projecting apparatus; the slightest shift in the wind or the smallest mistake by the crane operator will result in the hatch cover swinging and smashing against a projecting arm mechanism, crushing it. This system inherently is prone to high downtime due to damage. Also, the necessity for a pivoting arm apparatus atop the uppermost container raises the ship's center of gravity. An effective system should avoid placing heavy apparatus at such a great distance from the deck.

Thus, the result of considerable effort in the prior art has not produced apparatus which meets all of the criteria outlined above. The container shipping industry remains in need of effective, easy-to-use, compact means for securing on-deck containers.

SUMMARY OF THE INVENTION

The broad object of this invention is to provide apparatus for securing on-deck containers.

A further object of this invention is to provide apparatus which allows for rapid loading and unloading of containers.

Another object of the present invention is to provide container securing apparatus which allows removal of a hatch cover without necessitating dismantling of the apparatus, yet without risk of damage to the apparatus during removal of the hatch cover.

A still further object of this invention is to provide securing apparatus which does not raise unduly the ship's center of gravity.

These and other objects are achieved by the present invention. Broadly, the container-securing apparatus disclosed herein comprises a tower assembly, having vertical towers joined by cross-members positioned on either side of a container stowage area—typically, a cargo hatch. Cantilevered platforms extend between the towers, mounted to swing between upright and extended positions. in its upright position, a cantilevered platform lies in a plane completely behind the face of a tower assembly. In its extended position, a platform extends outwardly from the tower assembly into the stowage area. Each cantilevered platform is fitted with plates which overlap onto the top of a container. Each plate carries one or more vertical locating dowels, positioned to engage the vertical locating aperture of a container to be stacked thereon. The cantilevered platform carrying the topmost container in a stack also carries a locking dowel which engages the horizontal aperture at the bottom of the topmost container. Thus, the stack of containers is held in position without the necessity for apparatus engaging the top of the uppermost container.

DETAILED DESCRIPTION OF A PREFERRED EMBODIMENT

Figure 1:
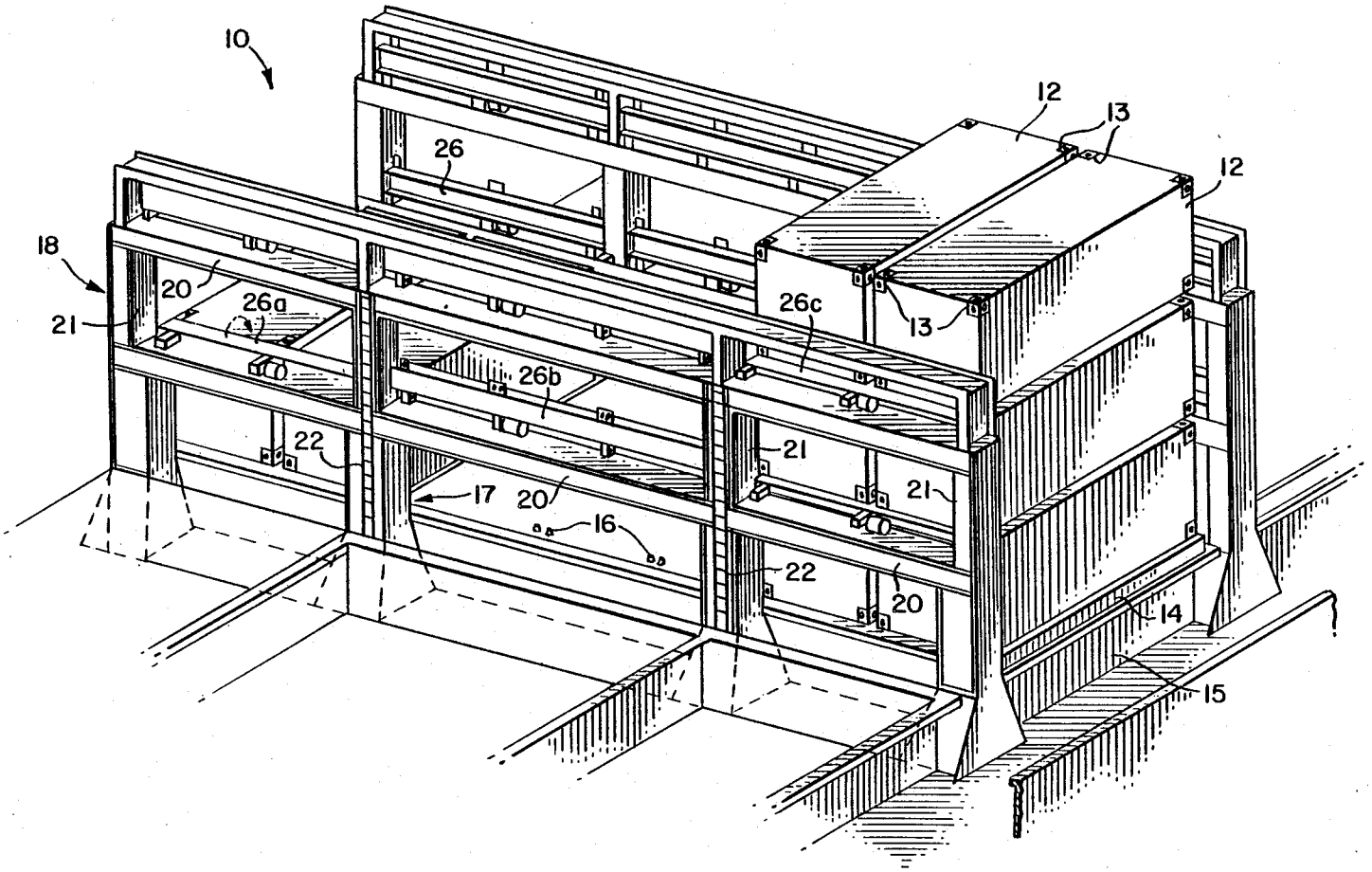
FIG. 1 is a pictorial of the invention in use on a containership.

A typical installation embodying the present invention 10 is shown in FIG. 1. Normally, on-deck containers are stacked on hatch covers, although they may be stacked on any open area of deck. Several hatch covers, mounted athawrtships side-by-side, provide access to a hold section. Thus, containers are loaded into the hold, the hatch covers replaced, and then containers are stacked on the hatch covers and secured. The typical installation shown in FIG. 1 employs three hatch covers. The outboard covers accommodate two container stacks each, while the center cover accommodates three stacks. The resulting arrangment of containers can be visualized in two dimensions. Vertically, the containers form stacks; horizontally, they form tiers—a first tier and subsequent tiers (one or more intermediate tiers and an upper tier). The example is shown with but one assembly installed, but, of course, a containership fully fitted out with the present invention would have similar installations at each container stowage area.

Containers 12 have locating apertures 13 in each corner of the top, bottom, sides, and ends. Hatch covers 14 carry castings 17, which are L-shaped container guides, and deck-mounted dowels 16 positioned to engage the locating apertures on the underside of the lowermost container in each stack. These dowels and guides position the containers and prevent side-to-side movement. As an alternative to such dowels, the industry often employs twist-lock devices for engaging container apertures. The two devices are equivalent in function. The use of the term "dowel" herein encompasses twist-locks and all similar, equivalent devices.

Tower assemblies 18 stand immediately fore and aft of hatch coamings 15. Constructional details may be modified to suit individual circumstances, but it is preferred that each assembly be an integral unit extending the width of the hatches. Each assembly includes vertical towers 21 tied together by cross-members 20, and ladders 22 may be provided for ease of access to the containers. As shown, each assembly includes four towers, two located at the outer extremity of the outboard hatches and two between the ends of the center hatch and the outboard hatches. Two sets of cross-members join the towers, located with their top surfaces slightly below the tops of the first and second tiers of containers, as explained below. The tower assemblies thus define three storage bays corresponding to the three hatches. It is preferred to use conventional structural steel for the tower assemblies, welded to the deck.

Figure 2:
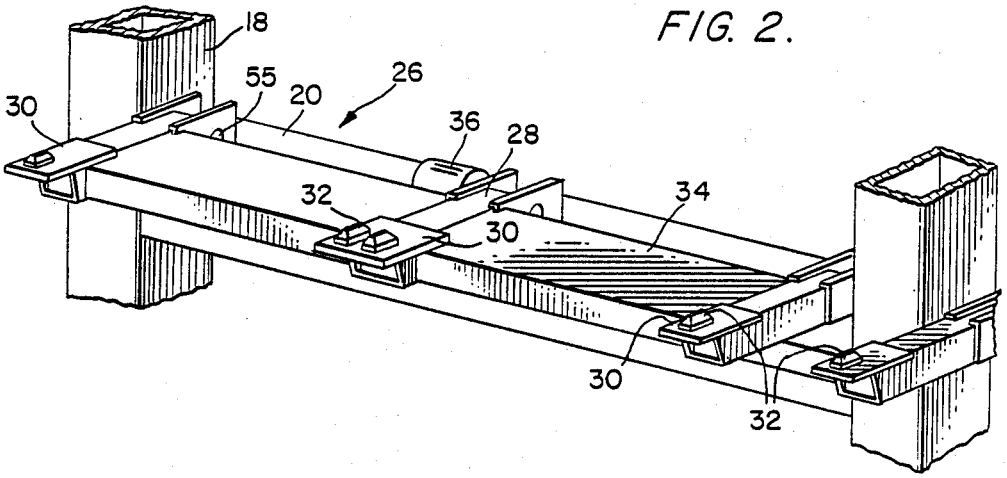
FIG. 2 is a detailed pictorial of a cantilevered platform.

Cantilevered platforms 26 are carried on the upper surfaces of cross-members 20, as best seen in FIGS. 1 and 2. Each platform generally includes a series of pivot arms 28, joined by beams 34. A plate 30, carrying one or more upwardly projecting dowels 32 is mounted at the projecting end of each pivot arm. One platform is mounted on each cross-member, so that the total number of platforms depends upon the tower assembly design. The installation of FIG. 1 has six platforms, as shown. Mounting details are discussed hereafter, but it should be noted that platforms pivot between an extended position **26*a* (FIG. 1) in which the platform projects into the container stowage bay, and an upright position 26*b*, in which the platform is nested into the space between adjacent vertical towers, completely behind the face of the tower assembly. It also should be noted that the installation shown in FIG. 1** depicts a single installation of the present invention; in a complete installation for a containership, some tower assemblies will be located between two adjacent container stowage areas; then, the tower assemblies would be dimensioned to carry cantilevered platforms extending both fore and aft into the respective stowage bays.

Before considering the construction of the cantilevered platform in detail, it is helpful to consider the operation of the invention generally. FIG. 1 shows the apparatus in several stages of operation. Before any containers are stowed, as seen in the center bay of FIG. 1, the cantilevered platforms are held in an upright position **26*b*. Here, the entire platform is behind the front face of the tower assembly. The first tier of containers is shown stowed in the leftmost bay of FIG. 1. These containers are engaged by castings 17 and dowels 16 to hold them in position. After the first tier is loaded, the adjacent cantilevered platforms are lowered to their extended positions 26*a*. In this position, the projecting portions of plates 30 lie atop the containers, with dowels 32 vertically aligned with hatch cover dowels 16. As each subsequent tier of containers is loaded, the vertical locating apertures on the underside of each container engage dowels 32 carried on the cantilevered platforms, retaining each container in side-to-side position. It should be noted that no cantilevered platforms overlap the upper surface of the uppermost tier of containers. Rather, the cantilevered platform 26*c* upon which the uppermost tier rests, seen in the rightmost bay of FIG. 1**, includes means, discussed below, for securing the uppermost container in each stack without the necessity of an additional cantilevered platform.

The pivot arms 28 take several forms, based upon common constructional features, as seen, for example, in FIG. **3*a*. The arm is built around an extension member 42, formed from a section of box beam. Two pieces of flange stock are fixed to the sides of the extension member to form a shoulder 40 extending rearward of the extension member. A shaft aperture 38 is formed in that portion of the shoulder to the rear of the extension member. The forward end of the extension member carries a rectangular plate 30, overlapping the upper surface of the extension and projecting forward from it. One or more dowels 32 (as explained below) project upwardly from the upper surface of plate 30**. Design of these dowels may be altered to adapt to different locating aperture designs, but it is preferred that each dowel have a lower portion of rectangular cross-section followed by a portion having the form of a truncated pyramid. Constructional details of the pivot arm may be selected to fit particular circumstances, but it is preferred to use structural steel members, welded together, with the total distance from the vertical center line of the shaft aperture to the center line of the dowel being about 28 inches.

Figure 3A:
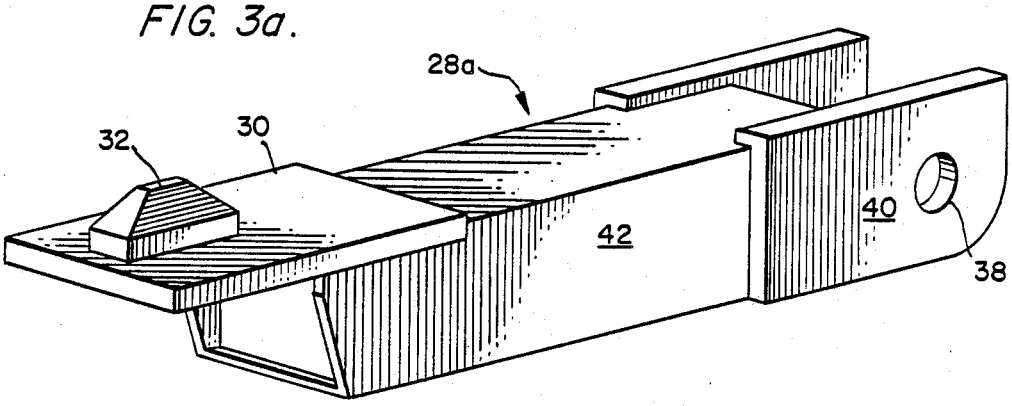
FIG. 3 is a detailed pictorial of inner and outer intermediate tier pivot arms.
Figure 3B:
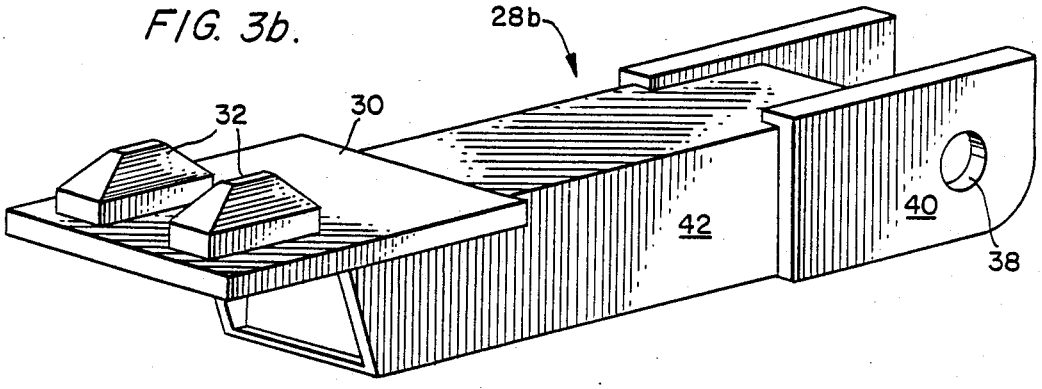
Figure 4A:
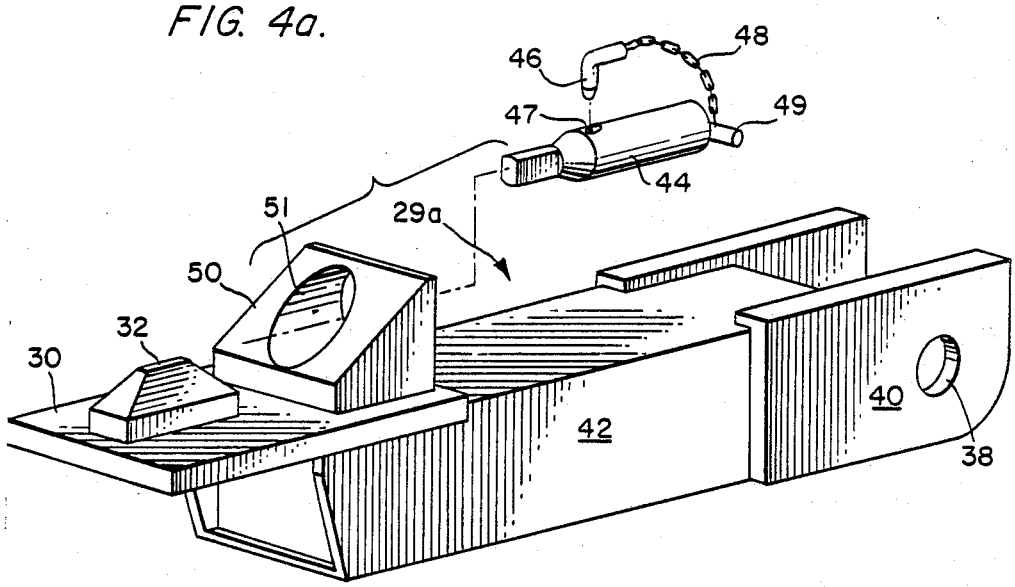
FIG. 4 is a detailed pictorial of inner and outer upper tier pivot arms.

Based upon these common features, four types of pivot arms are employed, classified according to their location on the tower assembly. The first distinction is whether the particular arm is used in conjunction with an intermediate tier of containers (e.g., platform 26*a*, FIG. 1) or the upper tier (e.g., platform 26*c*, FIG. 1). The second distinction is whether the particular pivot arm is located at the end of or inboard on the platform (see FIG. 2). Thus FIG. 3*a* shows an intermediate tier outer arm 28*a* and and FIG. 3*b* shows an intermediate tier inner arm 28*b*; FIG. 4*a* shows an upper tier outer arm 29*a*, FIG. 4*b* shows an upper tier inner arm 29*b*.

The only difference between inner and outer arms is that each outer arm (28*a* or 29*a*) carries only one dowel 32, while each inner arm (28*b* or 29*b*) carries two dowels. The plates 30 carried on inner arms are, of course, wider than those on outer arms, to accommodate the extra dowel. This design stems from the need for inner arms to accommodate two containers resting on each plate, as can be seen in FIG. 1. The dowels 32 are identical for each type of arm; the difference appears only in the number of dowels and the width of the plate.

Figure 6:
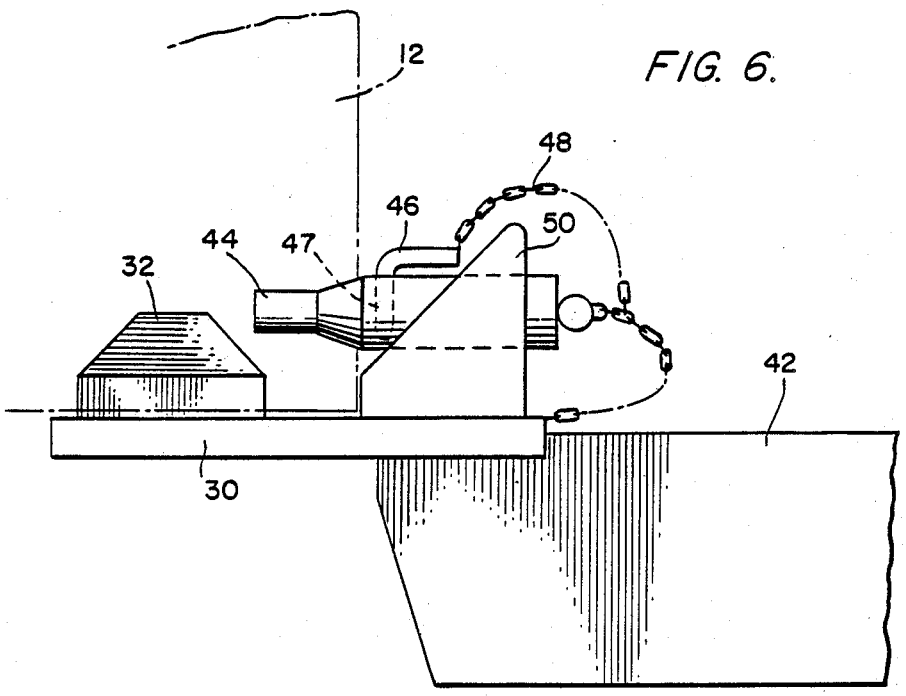
FIG. 6 is a detailed view of the locking dowel and mounting block.

Upper tier pivot arms 29*a* and 29*b* (FIGS. 4*a*, 4*b*, and 6) add an important feature. In addition to dowels 32, each plate 30 also carries a mounting block 50. This block is mounted to the rear of the dowel and has an aperture 51 passing through it from front to rear, parallel to the long axis of the pivot arm. It is preferred that the forward face of the mounting block be sloped rearward to assist in locating a container on the vertical dowel 32. The mounting block receives and carries locking dowel 44, which engages the horizontal locating aperture of a container (located at the bottom corners of the end of the container) to hold it in vertical position. The forward portion of this dowel, which engages the container, has a square cross-section; the dowel then flares outward to a rear portion of circular cross-section, adapted to be carried in the mounting block. Once the dowel is inserted in the mounting block, it is held in position by a retaining pin 46, which may be a piece of right-angled round stock, inserted into a transverse bore 47 formed in the rear portion of the dowel. (See FIG. 6). The position of the bore is chosen to insure that the locking dowel projects sufficiently forward from the mounting block to perform its locating function on container 12 (shown in phantom on FIG. 6). For ease of handling, a chain 48, joining the retaining pin to the locking dowel, and a handle 49 at the rearward end of the locating dowel, may be provided.

Figure 4B:
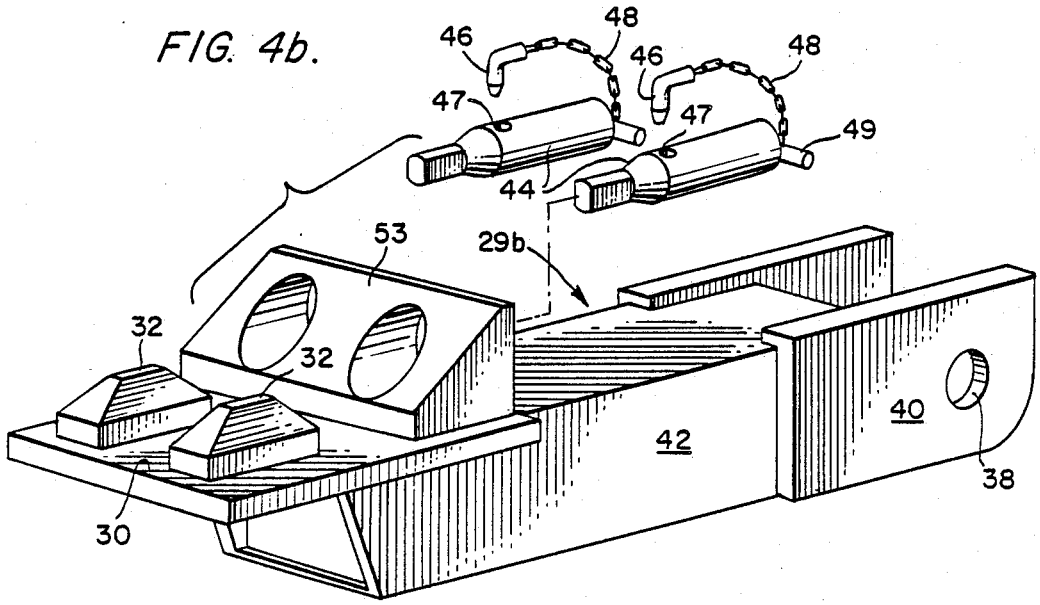

As with the lower tier arms, two forms of the upper tier arms are employed (FIGS. 4*a* and 4*b*). Upper tier outer arms 29*a* carry one dowel and one mounting block each (FIG. 4*a*), while upper tier inner arms 29*b* each carry two dowels and a double mounting block 53 (FIG. 4*b*).

Each pivot arm pivots on a hinge 52 secured to a cross member 20. Best seen in FIGS. 2 and 5, two vertical members project upward from the hinge base to fit within the pivot arm shoulder 40. A hinge shaft 55 (FIG. 2), secured by cotter pins or other suitable means, joins the pivot arm to the hinge, leaving the pivot arm free to rotate between upright and extended positions.

Figure 5:
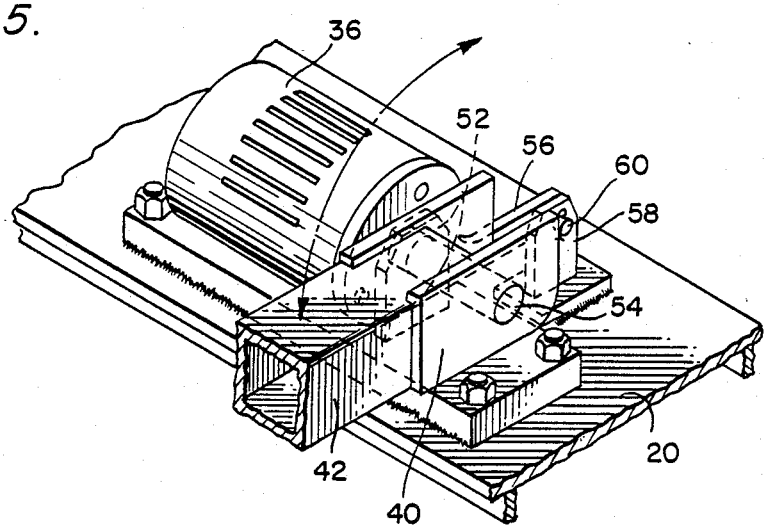
FIG. 5 is a detailed pictorial of the mounting arrangement and rotary actuator of a pivot arm.

Pivotal movement of the cantilevered platform is accomplished by hydraulic rotary actuators 36. One actuator is provided for each platform, mounted on an inner pivot arm (FIG. 2). For pivot arms which carry actuators, the arm and hinge are joined by an actuator shaft 54, elongated to carry the actuator (FIG. 5). One end of a torque arm 56 is suitably attached to the face of the actuator, and its other end is fixed between the U-shaped flanges of an anchor 58 mounted on the cross-member. The actuator may be keyed or otherwise suitably attached to shaft 54, and the torque arm may be bolted to the actuator and connected to anchor 58 by a pin 60. It is preferred that both the anchor and the hinge base be welded to the cross member; the hinge base additionally may be through-bolted, as shown. The rotary actuator may be, for example, a Bird Johnson Model HS-15-280 Rotary Actuator, readily available to the art.

Operation of the apparatus proceeds as follows. As described, the first tier of containers is loaded and is retained in place by castings 17 and on-deck dowels 16. During loading, all cantilevered platforms are held in their upright positions, preventing any possibility of damage to the platforms from impact with a container. Then, the first level of cantilevered platforms is lowered to their extended positions. As is apparent, the cross-members 20 must be located substantially equal to the level of the bottom of each subsequent tier of containers, so that when plates 30 lie atop the containers, the pivot arms are substantially level. Dowels 32 are then in vertical alignment with on-deck dowels 16, so that as the second tier of containers is loaded and engages the dowels, subsequent containers in a stack are located exactly atop one another. This process is repeated until the uppermost tier of containers is loaded. Although FIG. 1 shows an installation for stacking containers three tiers high, other installations could stack containers more or less high, employing the present invention. After the uppermost tier is loaded, locking dowels 44 are inserted through mounting blocks 50 into the horizontal locating apertures in each container. With retaining pins 46 in place, the uppermost container, and thus the entire stack, is restrained from vertical movement.

The present invention solves a long-felt need of the container shipping industry in a manner superior to that of the prior art. First, containers are securely held in position, preventing damage. Second, the system is easy to use. The present invention permits securing to proceed as rapidly as containers can be on-loaded. Moreover, no maintenance of the apparatus is required to retain the containers in a secure condition during a voyage. Third, the apparatus minimizes the raising of the ship's center of gravity. Because no machinery is needed atop the uppermost tier of containers, the apparatus maintains stability to the greatest possible degree. Fourth, the apparatus itself is durable and inherently free from problems. Because the cantilevered platforms can be retracted completely behind the face of the tower assembly, containers can be handled and hatch covers removed and replaced without fear of damaging the apparatus.

Those skilled in the art will be able to vary the details of the present invention to suit particular circumstances. For example, the apparatus easily can be adapted to installations requiring containers stacked in excess of three high. Similarly, different ship widths can be accommodated by varying the number of container bays and the number of stacks held within each bay. These and other variations are possible without departing from the spirit of the present invention, defined by the claims appended hereto.

We claim:

1. A system for securing a plurality of intermodal containers to a container ship, said system comprising:

(a) a container ship for shipping a plurality of intermodal containers between ports, said container ship having a plurality of removable hatch covers mounted on a deck of the container ship to provide access therethrough;

(b) a plurality of removable intermodal cargo containers to be secured above deck during transit of the container ship between ports, wherein the containers are arrayed in a plurality of rows of stacks of containers, each stack having at least three containers, a first lowermost tier, and a last uppermost tier, each of said containers having castings for moving and securing the containers;

(c) a plurality of dowel means mounted on said hatch covers for securing the first lowermost tier of containers thereto;

(d) at least two tower assemblies spanning at least one of the hatch covers to define a stowage bay thereabove, each of said tower assemblies having a plurality of vertical towers mounted on said deck and aligned athwartship along said hatch cover(s) with a plurality of cross-members extending between said towers to create a rigid free-standing assembly which defines a plurality of protective wells therewithin;

(e) a plurality of rows of nestable and pivotable platform means mounted on said tower assemblies, said platform means arrayed for association with the rows and stacks of containers, each of said platform means pivotable from a horizontal position for engagement of said containers to a vertical position completely nested within a protective well of the tower assembly;

(f) a plurality of container-engaging plates mounted on each of said pivotal platform means, each plate having at least one dowel means thereon for engaging the corner castings of associated container(s), wherein said plate(s) are placed between adjacent tiers of associated containers when the container ship is loaded to transmit vertical load forces directly therethrough, from container to container, to the hatch cover therebelow;

(g) at least one locking means mounted on the container engaging plate(s) mounted on the last and uppermost row of pivotable platform means, whereby the last and uppermost tier of containers is secured and locked to its associated pivotable platform;

(h) a plurality of motor means mounted wholly within said protective wells for selectively pivoting said platform means between their container-engaging position and their nested and protected position within said wells, wherein said rows of pivotable platform means are nested within and protected by said towers during removal and installation of said hatch covers and containers, and selectively and successively lowered into their horizontal container engaging position after the tier of containers immediately therebelow has been loaded.

2. A system for securing a plurality of intermodal containers to a container ship as claimed in claim 1, wherein said pivotable platform means further comprise an elongated planar member mounted on at least two pivotable arms, with said motor means adopted to selectively pivot said arms and platform from a protected and vertical position to a horizontal container-engaging position.

3. A system for securing a plurality of intermodal containers to a container ship as claimed in claim 2, wherein said locking means for the uppermost tiers of containers includes:

(a) an alignment guide for guiding the uppermost container into alignment as it is lowered to its associated load bearing plate;

(b) a locking dowel means extending through said alignment guide for engaging a casting carried by said container to thereby secure said uppermost container to its associated load bearing plate.

4. A system for securing a plurality of intermodal containers to a container ship as claimed in claim 3, wherein said alignment guide comprises a first diagonal guide surface for engaging said container as it is lowered, and a horizontal bore extending through said guide surface for receiving said dowel means.

5. A system for securing a plurality of intermodal containers to a container ship as claimed in claim 3, wherein alternate load bearing plates define two alignment guides and have associated therewith two locking dowels for engaging a pair of containers to be mounted adjacent to one another.

6. A system for securing a plurality of intermodal containers to a container ship as claimed in claim 1, wherein a single hydraulic motor means is mounted on each of said cross members, with a single hydraulic means associated with each pivotable platform means.

* * * * *